US009701324B2

(12) United States Patent
Brandt

(10) Patent No.: US 9,701,324 B2
(45) Date of Patent: Jul. 11, 2017

(54) RAILCAR POSITIONING SYSTEM FOR CURVED TRACK

(71) Applicant: Calbrandt, Inc., Delano, MN (US)

(72) Inventor: Calvin J. Brandt, Delano, MN (US)

(73) Assignee: Calbrandt, Inc., Delano, MN (US)

( * ) Notice: Subject to any disclaimer, the term of this patent is extended or adjusted under 35 U.S.C. 154(b) by 175 days.

(21) Appl. No.: 14/614,704

(22) Filed: Feb. 5, 2015

(65) Prior Publication Data

US 2016/0229431 A1 Aug. 11, 2016

(51) Int. Cl.
*B61J 3/06* (2006.01)
*B61J 1/12* (2006.01)

(52) U.S. Cl.
CPC .. *B61J 3/06* (2013.01); *B61J 1/12* (2013.01)

(58) Field of Classification Search
CPC ..... B61J 3/00; B61J 3/04; B61J 3/06; B61J 3/08; B61K 7/00; B61K 7/02
See application file for complete search history.

(56) References Cited

U.S. PATENT DOCUMENTS 6,668,730 B2 * 12/2003 Goldbeck ..... B61J 3/06 104/162
7,934,457 B2 * 5/2011 Brandt ..... B61J 3/08 104/162

* cited by examiner

*Primary Examiner* — R. J. McCarry, Jr.

(74) *Attorney, Agent, or Firm* — Nikolai & Mersereau, P.A.; C. G. Mersereau

(57) ABSTRACT

A chain and hydraulic motor-driven low dog railcar indexer is disclosed which is operable along a curved track section. The system includes left and right track side indexing railcar-moving arrangements, each of which includes an indexer track and a chain-return trough. The indexer tracks and chain return troughs are segmented to accommodate the curved railroad track section and wear pads are provided to enable chain operation in the curved section.

9 Claims, 5 Drawing Sheets

RAILCAR POSITIONING SYSTEM FOR CURVED TRACK

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates generally to trackside railway car handling equipment for positioning railcars along a track for loading or unloading operations. More particularly, the present invention relates to a train positioning system that employs a design that enables it to be operable along a section of curved tracks. The system uses two dog carriages and operates as an indexer against the bogey frames of railcars.

II. Related Art

Freight-hauling railway cars need to be precisely positioned proximate freight or cargo handling equipment during loading and unloading operations. Freight in the form of bulk cargo such as grain is typically loaded or unloaded with reference to stationary freight handling equipment such as chutes and conveyor equipment situated at fixed locations above or in pits beneath a specific portion of the track. Railcars for transporting grain or other such finely divided dry bulk agricultural commodities may be covered and designed with a plurality of spaced bottom discharge hopper bins or chutes accessing the main cargo storage volume. The chutes are closed by capstan-operated rack and pinion bottom closure gate systems.

In the loading and discharge operations, a connected engine roughly positions one end of a string of cars to be loaded or unloaded beneath or above the appropriate equipment at the desired fixed location. Because locomotives are not well suited for precisely positioning individual cars or even strings of cars along a railroad track, positioning devices known as train movers or positioners are located at fixed stations along the track. The positioning devices generally employ heavy pushing members known as railcar-engaging "dogs" to move the cars into position.

Positioning devices are generally classified in the industry as "indexers" or "progressors". Indexers may employ dogs carried by a pair of carriages operating along indexer tracks on built-in guideways located on the outside of each of the spaced rails of an associated track. Indexers are designed so that the carriages and associate dogs located on both sides of the track are coordinated to operate together in unison to engage and move a car or string of cars along the track. Thus, in indexer type bogey frame-engaging positioning devices, dogs on dog carriages spaced on opposite sides of the track are caused to engage the bogey frame at the same time to thereby provide a balanced force by pushing against both of the spaced sides of the truck bogey frame simultaneously.

Progressors designed to operate against bogey frames also operate along rails in built-in guideways on the outside of each of the spaced rails of a track with dogs that operate along each of the guideways spaced along the track. Rather than operating simultaneously against both sides of a bogey frame to move a car or string of cars, the dogs of a progressor are operated alternately against only one side of a bogey frame, to sequentially engage bogey frames so as to "hand off" the car or string of cars alternating between dogs on opposed sides of the track.

Operation as an indexer advantageously provides a balanced side-to-side force on the bogey frame and enables the total force of two dog carriage systems to be applied at once so that heavier loads may be moved. This also enables a balanced force to be applied against the bogey frames of lightly loaded cars which avoids a possible tipping situation which may occur when force is applied to one side only.

Heretofore, such railcar handling equipment has been constructed to operate only along sections of straight track either as an indexer or a progressor and it would provide a distinct advantage and answer a definite need in the art if such a system could be operated along a curved track section.

SUMMARY OF THE INVENTION

By means of the present invention there is provided a railcar positioning system operable in an indexing mode along a curved track section. The system includes left and right track side indexing railcar-moving arrangements positioned just outside and parallel to flanking the rails of a railroad track having a curved aspect. Each of the left and right track side arrangements includes a guideway in the form of an indexer track which extends along outside each rail of the track. In the vicinity of the curved track section, the indexer tracks are segmented into a plurality of connected short sections that are placed at slight angles with each other so as to follow the track curve. A dog carriage is mounted on each of the spaced indexer tracks and is provided with a pair of spaced dogs designed to address the front or rear of a bogey frame in a coordinated manner. Thus, in that embodiment, the system of the invention is configured as a reversing low dog indexer.

Each dog carriage of the indexer is chain and hydraulic motor driven with a dog carriage attached to both ends of a continuous chain. Wear pads are placed at every bend in the curved section as determined by angled joints between sequential short sections of the indexer tracks and associated chain return troughs. The structure may be further reinforced against chain side load forces.

The segmented indexer tracks and chain return trough wear pads enable smooth operation of the chain-driven system along a curved track section. A chain and hydraulic motor-driven low dog indexer in accordance with the invention with indexer carriage dogs on both sides of the track pushing together can apply a force of about 60,000 pounds against a bogey frame and reach speeds from 25 to 90 FPM. The indexer system of the invention can accommodate said sections with a curvature of up to about 10 degrees using a plurality of short five-foot indexer track and return trough sections.

BRIEF DESCRIPTION OF THE DRAWINGS

In the drawings wherein like numerals depict like parts throughout the same.

DETAILED DESCRIPTION

The following detailed description of the present invention describes the invention in terms of one illustrated embodiment. It will be understood that the system described is intended by way of presenting an example of the inventive concept and is not intended to limit the scope in any manner. A variation within the scope of the inventive concept may occur to those skilled in the art.

Figures 1, 2:
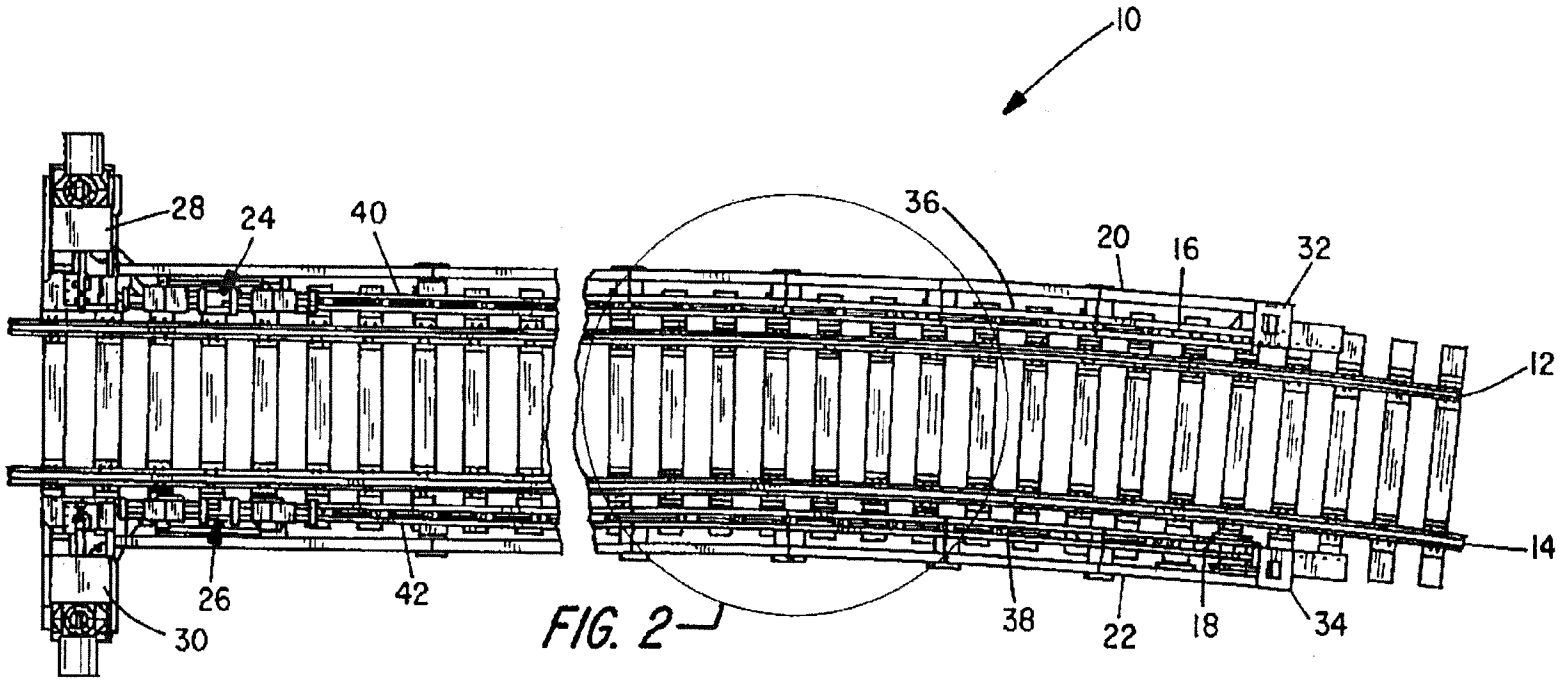
FIG. 1 is a broken schematic plan view of an indexer arrangement in accordance with the invention.
FIG. 2 is an enlarged fragmentary view of the area circled in FIG. 1.
Figure 2:
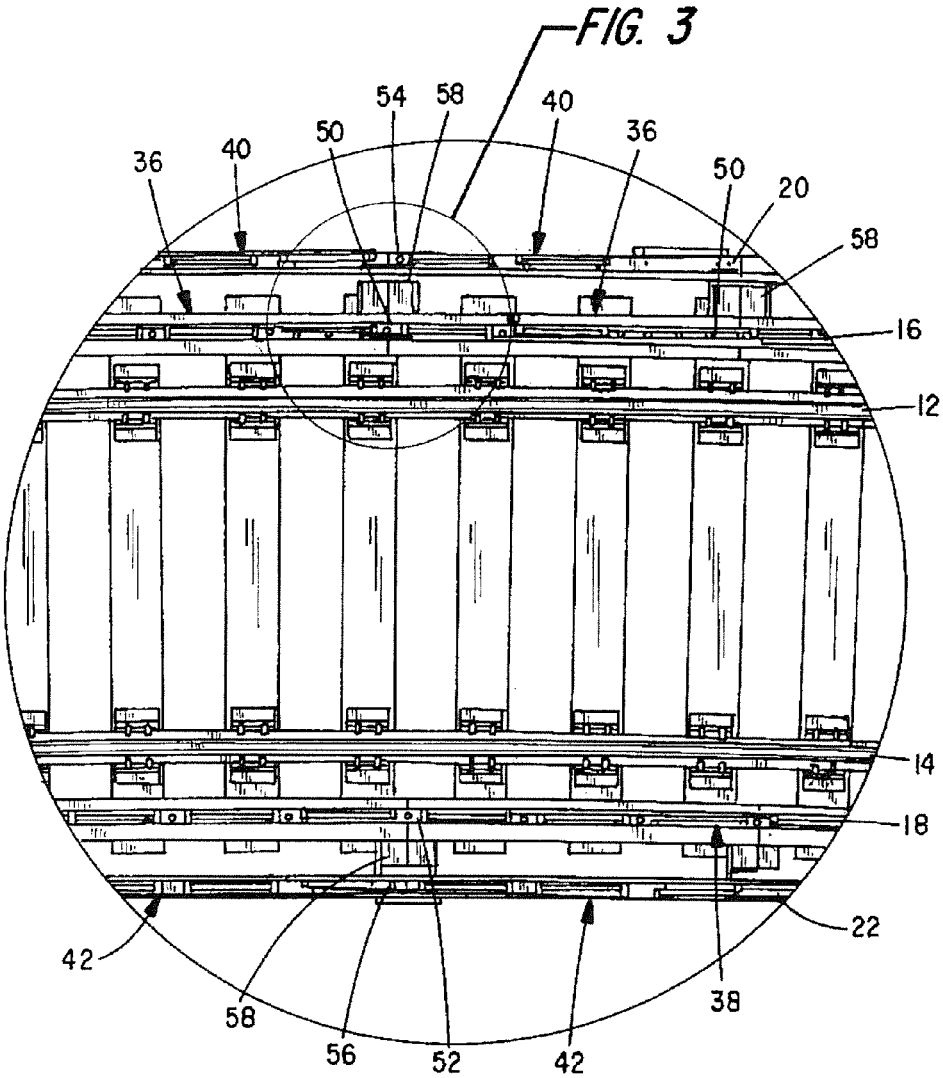

In FIG. 1 there is shown a broken schematic plan view or layout view of a segment of railroad track including an indexer arrangement in accordance with the invention. The layout, generally at 10, depicts a section of railroad track having a curved portion and a straight portion and includes spaced parallel rails 12 and 14 flanked by indexer tracks 16 and 18, respectively. Chain return troughs are shown at 20 and 22. The indexer arrangement or system includes dog carriages 24 and 26 with respective hydraulic motor drive units 28 and 30 and corresponding idler units 32 and 34.

In the curved section, the indexer tracks are divided into a plurality of short segments 36 and 38, which are shown at the outer and inner portion of the curve, respectively. The short segments may have a length of five feet. Longer, straight sections are shown at 40 and 42. These may have a length of twenty feet.

The area circled in FIG. 1 is accommodated in the enlarged view that is FIG. 2. Outer curve indexer wear pads 50 are placed at the interfaces of the angled outer curve indexer track 36, and inner curve indexer wear pads 52 are placed at the interfaces of the angled indexer track segments 38. Outer curve wear pads 54 are placed at the interfaces of the return trough segments 40 and inner curve return trough wear pads 56 are placed at the interfaces of the angled trough sections 42. It will be recognized that the wear pads 50 and 54 located in the indexer track and chain return trough, respectively, are placed on the inside of the corresponding track and trough inasmuch as this represents the outer portion of the curve and the chain will have the tendency to move in that direction and bear against the wear pads. Conversely, the indexer track and chain return trough wear pads 52 and 56 are located on the outer portion of the indexer track and chain return trough, respectively, as this represents the inner portion of the curve. Thus, the tendency of the chain to shift from one side or another as it negotiates the curve is compensated by the location of the wear pads which absorb side forces and enable the chain to slide past easily. Reinforcing structural members as at 58 may be added to take chain side loading that occurs in the curve.

Figure 3:
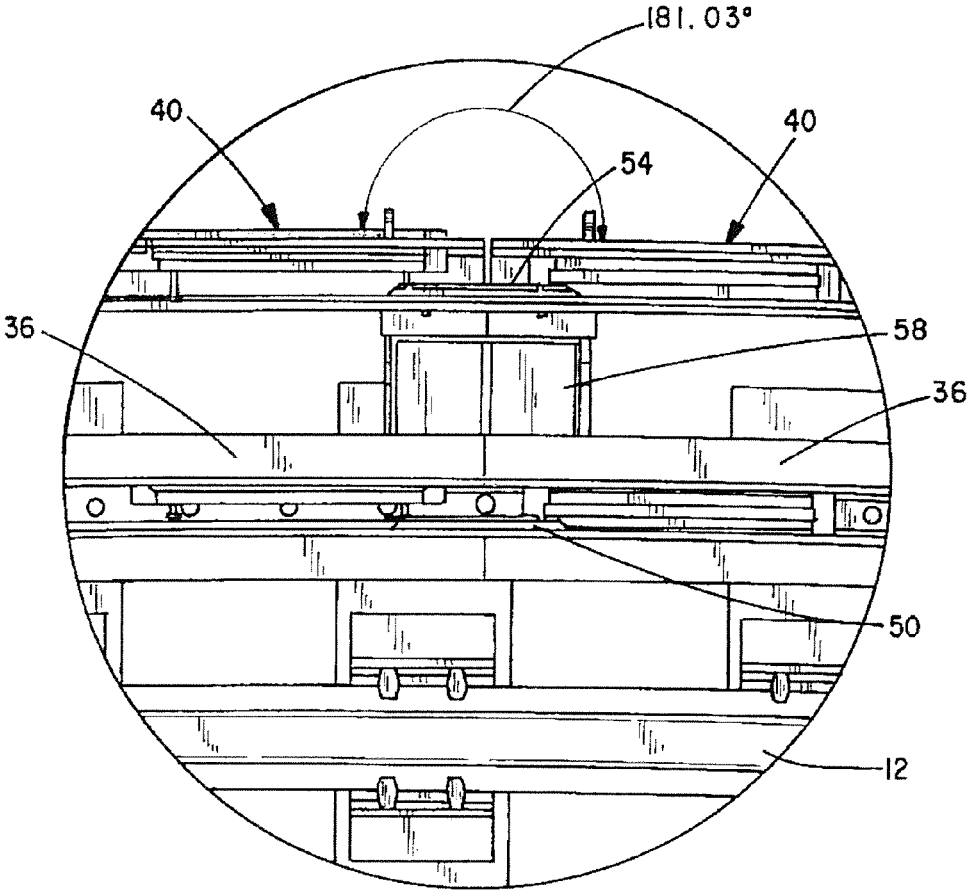
FIG. 3 is an enlarged fragmentary view of the area circled in FIG. 2.

FIG. 3 is a further enlarged fragmentary view of the area circled in FIG. 2 and shows the details of the interfaces between indexer track segments and chain return trough segments previously described. Note that the interface between the segments is slightly offset from a straight joint by 1.03 degrees. In this manner, the eight (8) curve segments shown in FIG. 1 would accommodate cumulatively a curve of about 8.24 degrees. It is anticipated that the railcar positioning system of the invention can operate on a track having a curvature of up to at least 10 degrees. Thus, the slight offset can be about 1.2 degrees or less. The angle between the segments is commensurate with the curvature of the railroad track.

Figure 4:
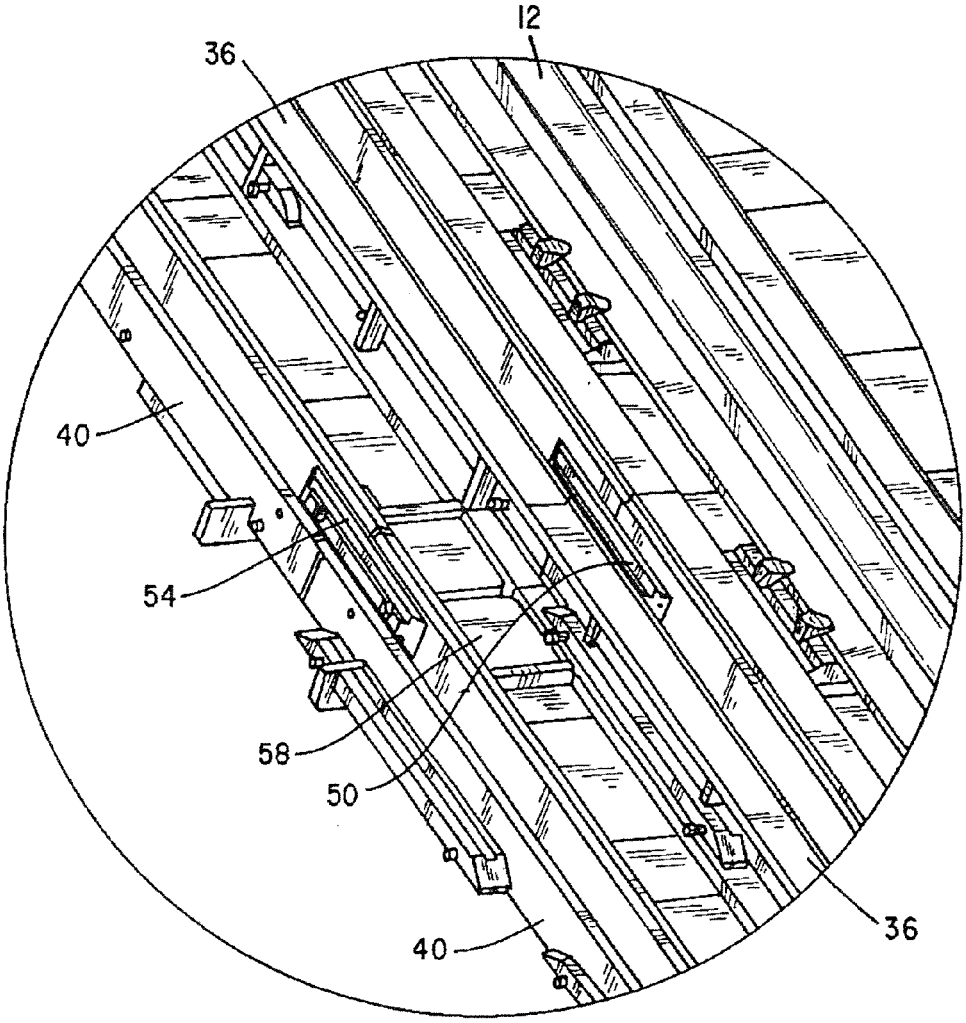
FIG. 4 is a fragmentary perspective view of a rail and indexer carriage track similar to that shown in FIG. 3.

FIG. 4 depicts a further enlarged fragmentary perspective view of a fragment of the layout similar to that shown in FIG. 3 depicting a joint between segments in the outside portion of the curved section, which has been further enlarged.

Figure 5:
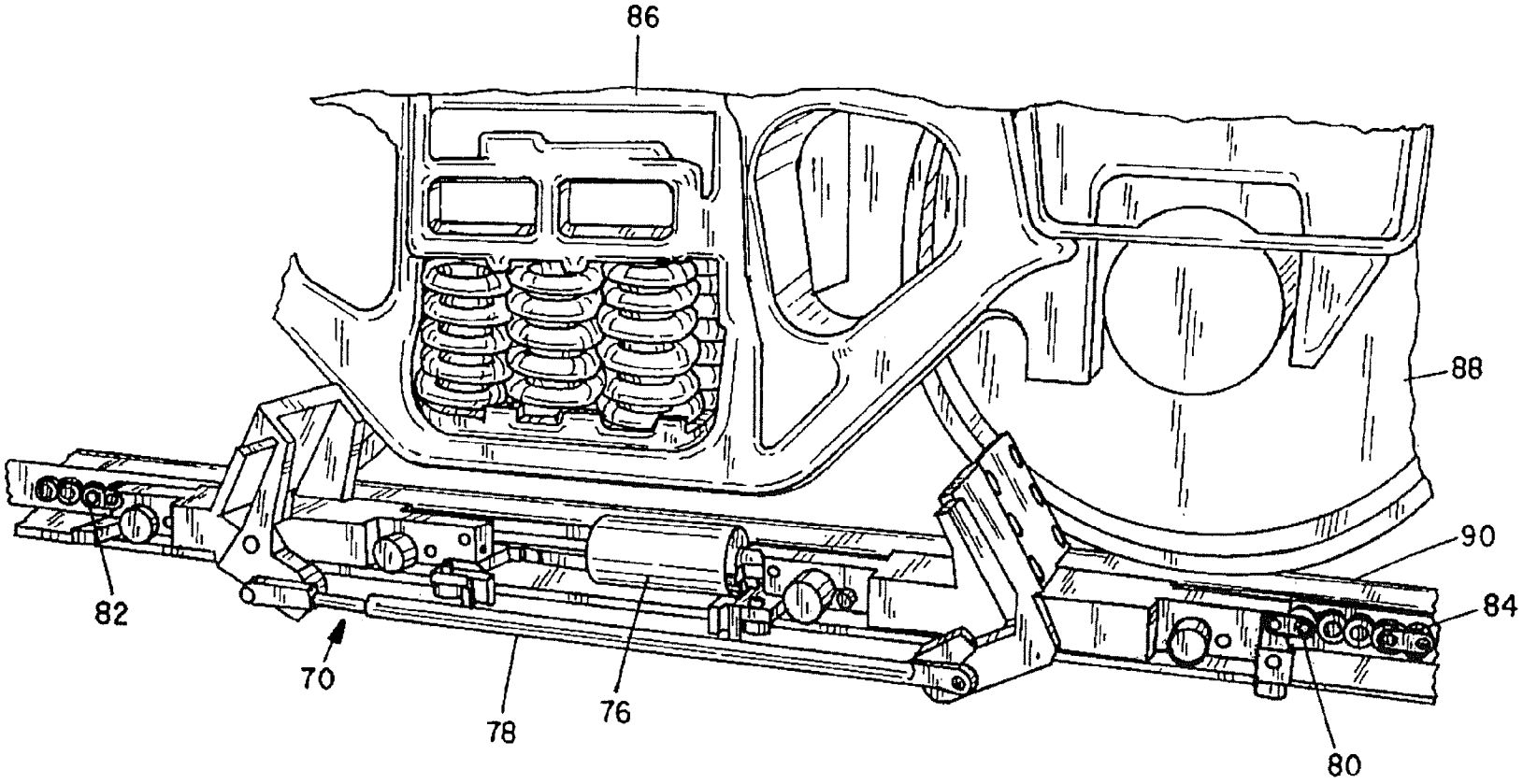
FIG. 5 is a drawing showing a dog carriage engaging a bogey frame of a railcar.

FIG. 5 depicts a greatly enlarged view of a dog carriage suitable for use in the indexer arrangement of the present invention and includes a dog carriage 70 with a pair of opposed dogs 72 and 74, shown in raised relation. A nitrogen tank is shown at 76 and a coordinating connection at 78, which raises and lowers the dogs in unison. Chain connections are shown at 80 and 82 with the connected chain 84. The dogs are shown addressing one side of a bogey frame 86 having associated wheels 88 operating along a track rail 90.

One skilled in the art would recognize that the operation of the hydraulic drive units to advance and retract the chain to advance and retract the carriages and the coordination of the raising and lowering of the dogs on the dog carriages of the indexer arrangement are well known and need not be repeated here in detail. The system of the embodiment of the detailed description is designed to operate the dog carriages in unison so that the dogs of both carriages 24 and 26 are coordinated to operate against both sides of a bogey frame in unison. A control unit is associated with the system and each of the hydraulic motors and carriages.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A railcar positioning system for a curved railroad track comprising:

(a) a pair of spaced trackside railcar-moving arrangements operable along a curved railroad track section one positioned outside and parallel to each rail of a railroad track including a curved railroad track section, each said railcar-moving arrangement further comprising:

(1) a segmented trackside guideway indexer track located next to one of the railroad rails wherein said guideway indexer track comprises a plurality of sequentially angled connected indexer track sections extending along said curved railroad track section;

(2) a dog carriage mounted for operation along said guideway, said dog carriage carrying at least one pusher dog mounted on said carriage;

(3) a continuous chain connected to operate said dog carriage along said guideway indexer track, said chain having an associated segmented return trough that comprises a plurality of sequentially angled connected trough sections extending along said curved rail section;

(b) a hydraulic power unit including a hydraulic motor connected to reversibly drive said chain; and (c) a control system associated with said power unit for controlling the operation of said positioning system such that said positioning system may be operated as an indexer.

2. A railcar positioning system for a curved railroad track as in claim 1 further comprising wear pads for absorbing chain side forces and enabling the chain to slide past easily, a plurality of said pads being associated with said guideway indexer track and said chain return trough.

3. A railcar positioning system for a curved railroad track as in claim 2 wherein said wear pads are located at connection areas between said plurality of indexer track sections and connection areas between said plurality of trough sections.

4. A railcar positioning system for a curved railroad track as in claim 1 wherein said plurality of connected indexer track sections are connected at an angle commensurate with an associated fraction of the track curvature angle.

5. A railcar positioning system for a curved railroad track as in claim 1 wherein said plurality of connected return trough sections are connected at an angle commensurate with the track curvature angle.

6. A railcar positioning system for a curved railroad track as in claim 4 wherein said plurality of connected return trough sections are connected at an angle commensurate with an associated fraction of the track curvature angle.

7. A railcar positioning system for a curved railroad track as in claim 3 wherein the wear pads located in the indexer track and chain return trough associated with the outside of an associated railroad track curve are placed on the inner portion of the corresponding indexer track and chain return trough.

8. A railcar positioning system for a curved railroad track as in claim 3 wherein the wear pads are located on the outer portion of the indexer track and chain return trough corresponding to the inner portion of a railroad track curve are placed on the outer portion of the corresponding indexer track and chain return trough.

9. A railcar positioning system for a curved railroad track as in claim 1 wherein each dog carriage carries two opposed, coordinated dogs.

* * * * *